US007791579B2

(12) United States Patent
Choi

(10) Patent No.: US 7,791,579 B2
(45) Date of Patent: Sep. 7, 2010

(54) AUTOMATIC RESET CIRCUIT

(75) Inventor: Yeon-Ho Choi, Gyeonggi-Do (KR)

(73) Assignee: LG. Display Co., Ltd., Seoul (KR)

( * ) Notice: Subject to any disclaimer, the term of this patent is extended or adjusted under 35 U.S.C. 154(b) by 928 days.

(21) Appl. No.: 11/585,037

(22) Filed: Oct. 23, 2006

(65) Prior Publication Data

US 2007/0262942 A1 Nov. 15, 2007

(30) Foreign Application Priority Data

May 11, 2006 (KR) ..... 10-2006-0042651

(51) Int. Cl.
*G09G 3/36* (2006.01)

(52) U.S. Cl. ..... 345/98; 345/213

(58) Field of Classification Search ..... 345/98–100, 345/213

See application file for complete search history.

(56) References Cited

U.S. PATENT DOCUMENTS 6,894,673 B2 * 5/2005 Koga et al. ..... 345/99
2004/0100435 A1 * 5/2004 Baek et al. ..... 345/98

FOREIGN PATENT DOCUMENTS

JP 2004208303 A * 7/2004

* cited by examiner

*Primary Examiner*—Richard Hjerpe
*Assistant Examiner*—Carolyn R Edwards
(74) *Attorney, Agent, or Firm*—Brinks Hofer Gilson & Lione

(57) ABSTRACT

A liquid crystal display (LCD) device includes a gate driver for supplying gate signals and a timing controller for generating a gate control signal to the gate driver. The LCD device further includes an automatic reset circuit which detects abnormal condition of the gate control signal and generates a reset signal.

11 Claims, 4 Drawing Sheets

AUTOMATIC RESET CIRCUIT

PRIORITY CLAIM

The present invention claims the priority to Korean Application No. 10-2006-0042651, filed on May 11, 2006, which is hereby incorporated by reference in its entirety.

BACKGROUND

1. Technical Field

The present invention relates to an automatic reset circuit for a liquid crystal display (LCD) device. In particular, the present invention relates to an automatic reset circuit which removes abnormal driving conditions of an LCD device.

2. Related Art

A liquid crystal display (LCD) device displays an image by controlling an optical transmittance of liquid crystal cells according to an input image signal. An active matrix type LCD device in which a thin film transistor (TFT) is formed at each liquid crystal cell can display a moving image better than a passive matrix type LCD device does.

FIG. 1 is a block diagram showing an LCD device 20 in accordance with the related art. In FIG. 1, the LCD device 20 includes a liquid crystal panel 11 having an upper glass substrate and a lower glass substrate. A liquid crystal is interposed between the upper glass substrate and the lower glass substrate. The liquid crystal panel 11 also includes a plurality of liquid crystal cells 11A, a data driver 12 and a gate driver 13. The data driver 12 supplies data to data lines DL1~DLm of the liquid crystal panel 11 and the gate driver 13 supplies a scan pulse to gate lines GL1~GLn of the liquid crystal panel 11.

The gate driver 13 generates a scan pulse by using a timing controller 10, and the generated scan pulse is sequentially supplied to the gate lines GL1~GLn. The gate driver 13 includes a shift register for sequentially generating a scan pulse, and a level shifter for shifting a swing width of a scan pulse voltage to be suitable for driving the liquid crystal cells 11A.

The data driver 12 samples video data which is input from the timing controller 10 and latches the video data. Subsequently, the data driver 12 converts the latched data into a gamma compensation voltage preset as a pixel data voltage and supplies it to the data lines DL1~DLm.

The converted data is synchronized in conjunction with each scan pulse every time a scan pulse is generated and is supplied to each of the data lines DL1~DLm during one horizontal period.

The liquid crystal cells 11A are arranged in a M×N matrix. M data lines DL1~DLm and N gate lines GL1~GLn are intersecting one another in the liquid crystal panel 11. A TFT for driving the liquid crystal cell 11A is formed at each intersection.

The TFT is turned on by a scan pulse supplied from the gate driver 13. A data signal on the data lines DL1~DLm is transmitted to each pixel electrode of the liquid crystal cells 11A.

A gate electrode of the TFT is connected to the same gate line GL1~GLn at each horizontal line, and a source electrode of the TFT is connected to the same data line DL1~DLm at each vertical line. Also, a drain electrode of the TFT is connected to each pixel electrode of the liquid crystal cells 11A.

Pixel electrodes of the liquid crystal cells 11A of each horizontal line are partially overlapped with the corresponding previous gate lines GL1~GLn for driving the liquid crystal cells 11A of the previous horizontal line. As a result, a storage capacitor is formed. For the pixel electrodes of a first horizontal line, a dummy gate line GL0 is used to form a storage capacitor. The dummy gate line GL0 is located above the first gate line GL1 and partially overlaps with the pixel electrodes of the first horizontal line.

A pixel voltage supplied to the data lines DL1~DLm is charged to a corresponding pixel electrode in response to a gate high voltage of a scan pulse supplied to each gate line GL1~GLn.

The gate high voltage of a scan pulse is sequentially supplied to the gate lines GL1~GLn. In response to the gate high voltage, the TFT is turned on and the storage capacitor of the liquid crystal cells 11A is charged with a corresponding pixel voltage. The pixel voltage is input through the data lines DL1~DLm. The pixel voltage maintains the charged voltage until the TFT is turned on again.

The LCD device 20 is sensitive to external static electricity. Due to the external static electricity, the LCD device 20 may experience abnormal display operations for a short time. Abnormal display operations may result from abnormal turn-on and turn-off of the gate driver 13. Manual reset may resolve the abnormal display operations. After the manual reset, the LCD device 20 recover from abnormal display operations. There is a need of a system that automatically resets the abnormal display operations.

SUMMARY

In one embodiment, a liquid crystal display (LCD) device includes a gate driver for supplying gate signals and a timing controller for generating a gate control signal to the gate driver. The LCD device further includes an automatic reset circuit which detects abnormal condition of the gate control signal and generates a reset signal.

In other embodiments, a driving method of a liquid crystal display (LCD) device having a gate driver and a timing controller includes supplying a gate control signal to the gate driver from the timing controller and determining the feedback status of the gate control signal. In the method, a detecting signal indicative of abnormal feedback status is generated and a reset signal in response to the detecting signal is produced. As a result, the reset signal is supplied to the timing controller.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE EXEMPLARY EMBODIMENTS

All circuit components of an LCD device may be subject to a general reset or a one-time reset. The general reset is performed to initialize an LCD device prior to the full operation. The one-time reset may be performed to resolve abnormal display operations, for example, resulting from external static electricity. The one-time reset may resolve abnormal display operations of the LCD device. The abnormal display operations may relate to external static electricity. The static electricity may delay or interfere with a signal flow. For example, the static electricity may delay flow of a gate control signal, a data control signal, or other types of signals for use in a liquid crystal display (LCD) device.

Figure 1:
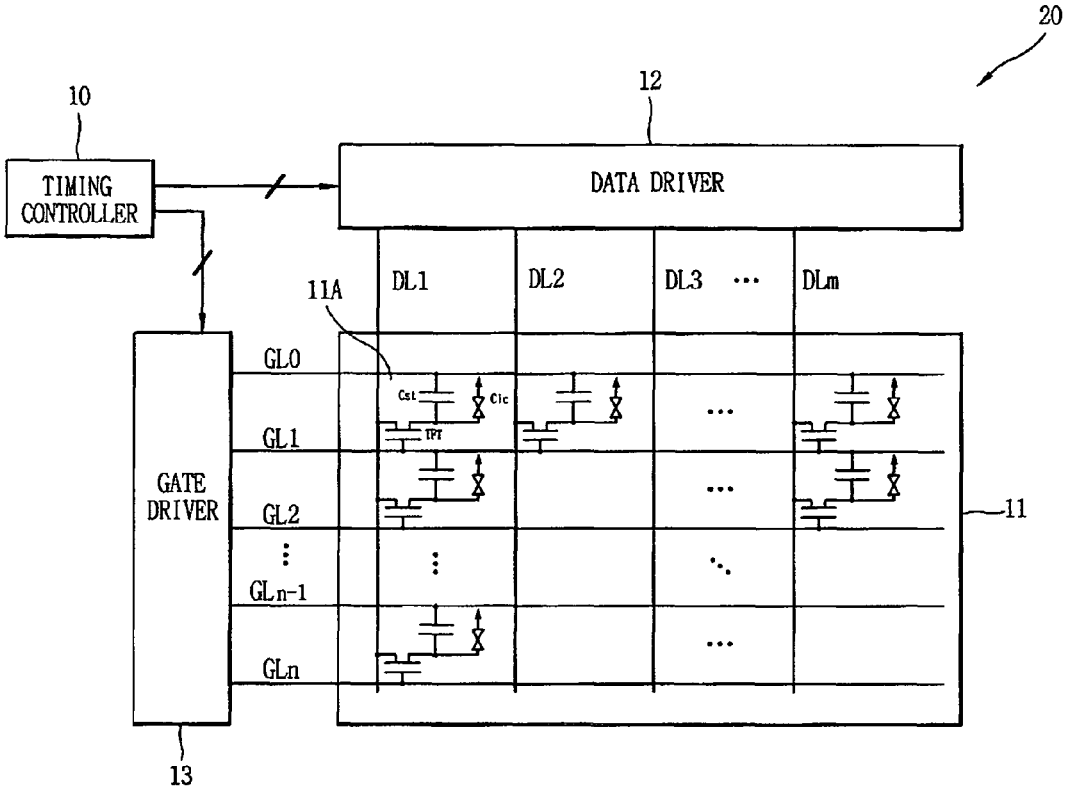
FIG. 1 RELATED ART
FIG. 1 is a block diagram showing a liquid crystal display (LCD) device in accordance with the related art.
Figure 2:
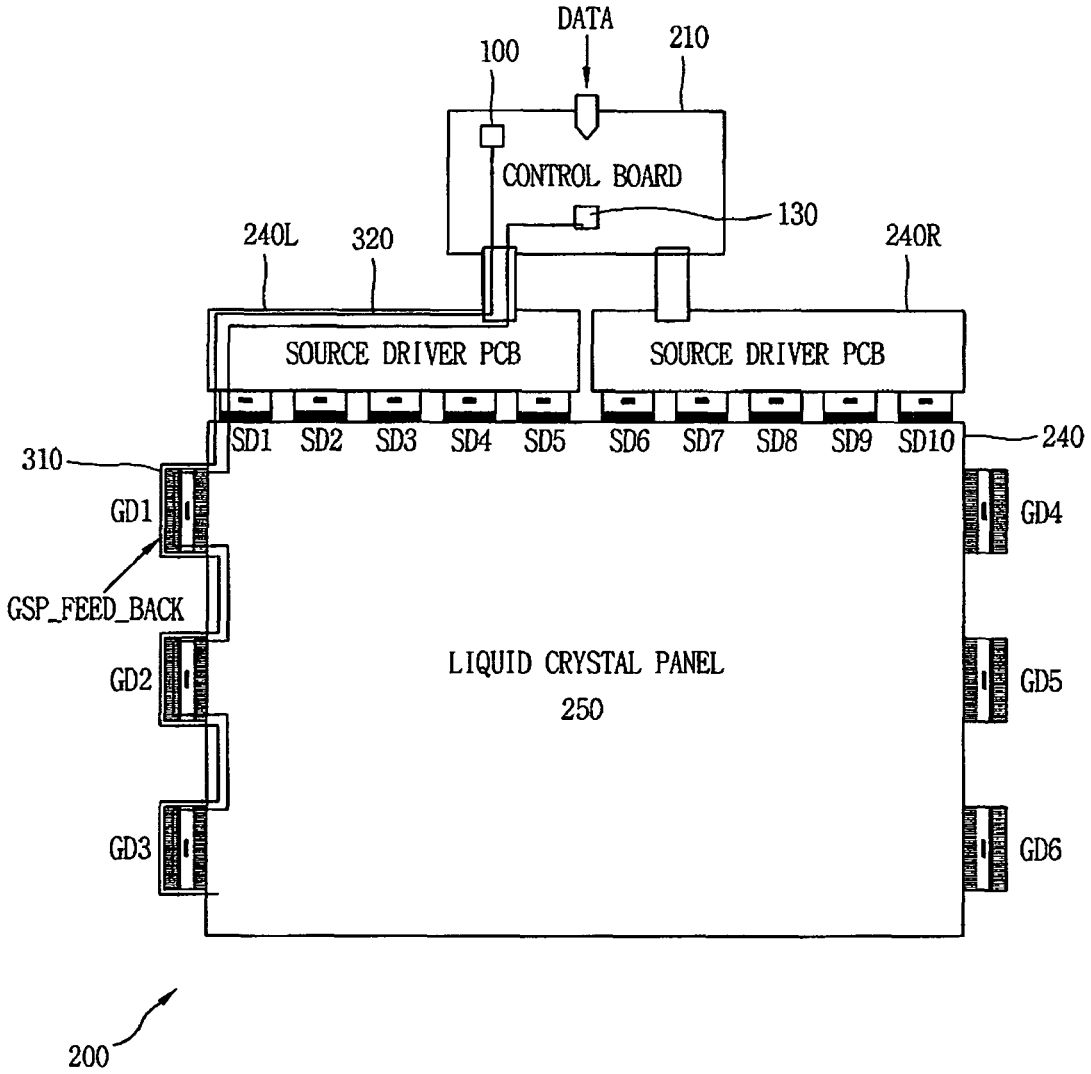
FIG. 2 is a schematic view of one embodiment of an LCD device.

FIG. 2 illustrates an LCD device 200 having a liquid crystal panel 250, a plurality of data drivers SD1~SD10 and a plurality of gate drivers GD1~GD6. The LCD device 200 also includes a control board 210 where an automatic reset circuit 100 and a timing controller 130 are mounted. The control board 210 is a printed circuit board (PCB).

The timing controller 130 re-aligns digital video data which is external input according to colors, i.e., R, G, and B. The timing controller 130 supplies the re-aligned data to data drivers SD1~SD10. The timing controller 130 generates a data control signal and a gate control signal by using horizontal/vertical synchronization signals input. The data control signal includes a dot clock (Dclk), a source shift clock (SSC), a source output enable (SOE), a polarity inversion signal (POL), etc. which are supplied to the data drivers SD1~SD10. The gate control signal includes a gate start pulse (GSP), a gate shift clock (GSC), a gate output enable (GOE), etc. which are supplied to gate drivers GD1~GD3 and GD4~GD6 installed at left 240L and right sides 240R of the liquid crystal panel 250, respectively.

Figure 3:
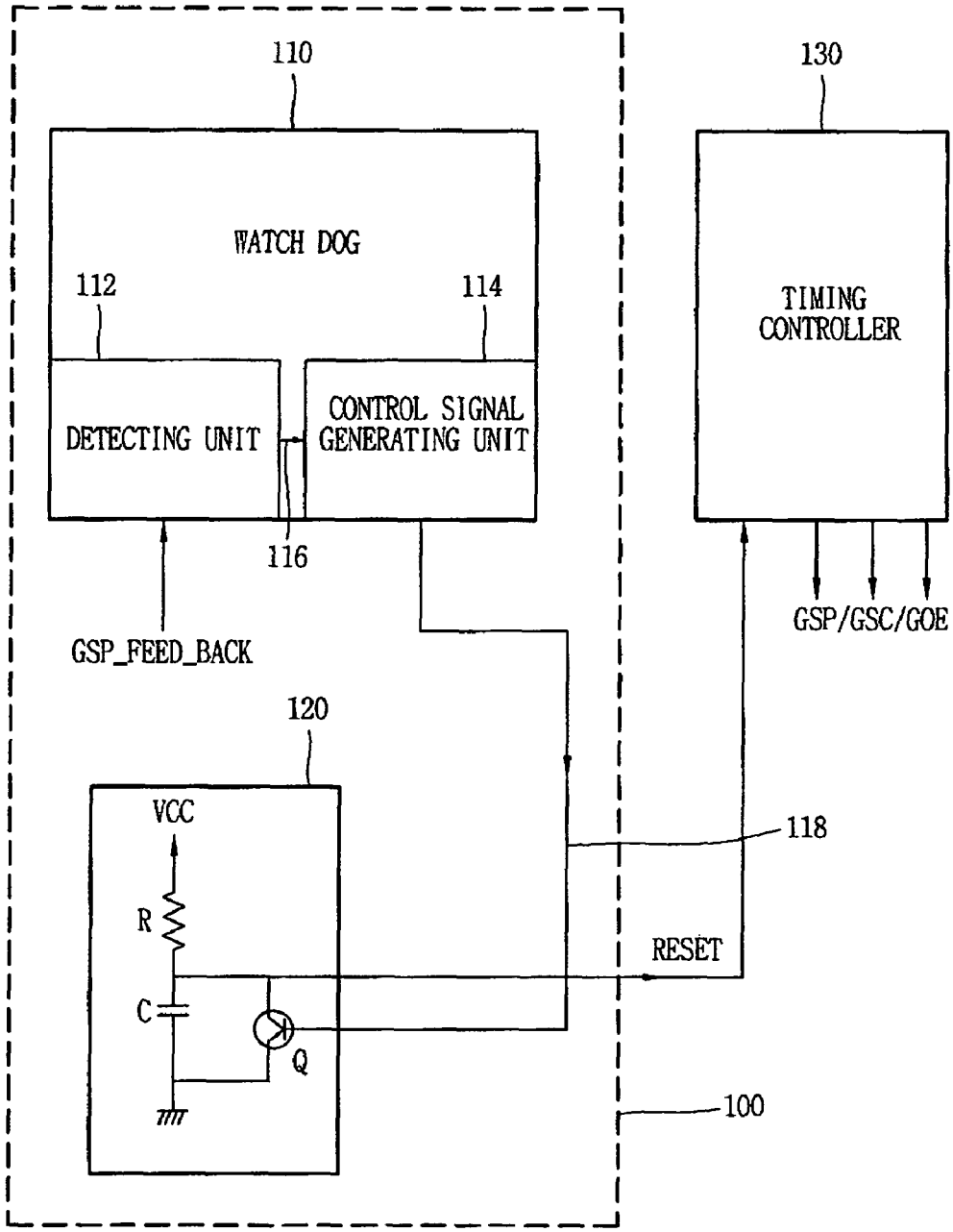
FIG. 3 is block diagram of an automatic reset circuit for use with the LCD device of FIG. 2.

As shown in FIG. 3, the data driver includes a plurality of data drivers SD1~SD10 for separately driving data lines. The data drivers SD1~SD10 supply each data line with a corresponding pixel signal during each horizontal period (H1, H2 . . . ) in response to data control signals SSP, SSC, SOE, and POL which are input from the timing controller 130. The data drivers SD1~SD10 convert the digital video data into an analog video signal by using a gamma voltage. The gamma voltage is output from a gamma voltage generating unit (not shown), which supplies the converted data to the data lines.

The gate control signals such as the gate start pulse (GSP), the gate shift clock (GSC), the gate output enable signal (GOE), etc. are supplied from the timing controller 130 and are sequentially transmitted to the gate drivers GD1~GD3 through a dummy pad. This dummy pad is located on a source driver printed circuit board (PCB) 240L which is positioned at one upper portion of the liquid crystal panel 240 and through the liquid crystal panel 240. The gate control signals are sequentially transmitted to the gate drivers GD4~GD6 through a dummy pad on a source driver PCB 240R positioned at another upper portion of the liquid crystal panel 240 and through the liquid crystal panel 240.

In the LCD device 200, a signal line 310 may be added to detect the feed back status of the gate control signal. In particular, the gate start pulse (GSP) may be used. In this embodiment, the gate control signal is used to detect abnormal operation or condition. In other embodiments, different types of signal such as a data control signal may be used. The gate control signal is supplied to a gate driver from the timing controller 130. When the gate control signal is provided, a signal GSP_FEED_BACK indicative of the feedback status of the gate control signal is generated via the signal line 310. For example, the signal GSP_FEED_BACk may count a number of the gate control signal that is fed back after the gate control signal is sent to gate lines. By way of example only, if the number of feedback signal is less than a certain number, e.g., 5 out of 10, it may indicate that the gate control signal is not properly supplied. If the number of feedback signal is, e.g., 8 out of 10, it may indicate that the gate control signal is properly supplied, although not perfect.

The automatic reset circuit 100 detects whether the gate control signal is normally fed back to a gate driver. The signal GSP_FEED_BACK indicative of the feedback status of the gate control signal is input to the automatic reset circuit 100, as shown in FIG. 2. This signal is provided from to the automatic reset circuit 100 via a signal line 320. The signal line 320 is located on a source driver PCB as shown in FIG. 2.

FIG. 3 is a block diagram showing one example of the automatic reset circuit 100 for the LCD device 200. The automatic reset circuit 100 for the LCD device 200 includes a watchdog unit 110 and a reset signal generating unit 120. In FIG. 3, the automatic reset circuit 100 performs the one-time reset. In other embodiment, the automatic reset circuit 100 may perform the general reset.

Figure 4A:
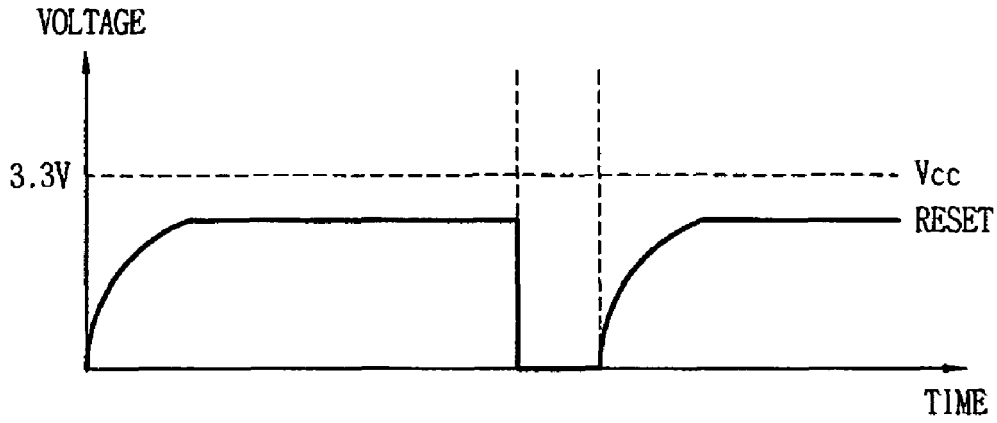
FIGS. 4A and 4B illustrate waveforms of a control signal and a reset signal generated in response to the control signal.
Figure 4B:
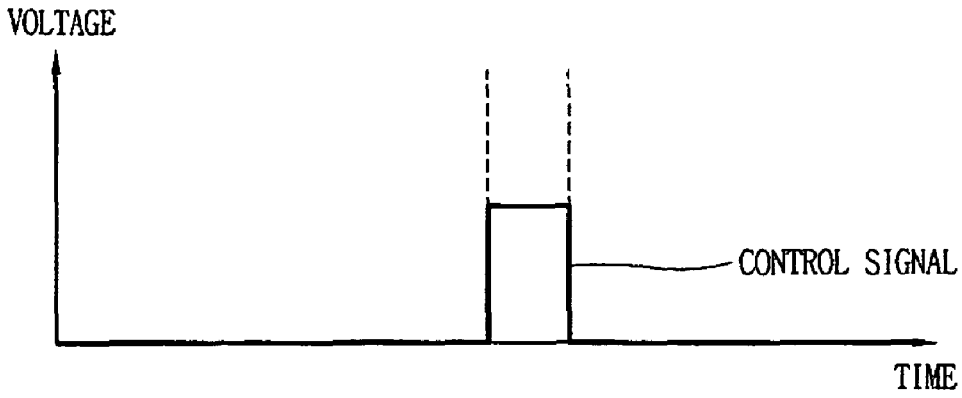

The watchdog unit 110 outputs a control signal when the gate control signal 118 is not normally fed back. The control signal 118 is transferred to the reset signal generating unit 120. In response to the control signal 118, the reset signal generating unit 120 generates a reset signal RESET. During the operation of the LCD device 200, the reset signal RESET maintains high. Upon receipt of the control signal 118, the reset signal RESET is instantaneously reset, as illustrated in FIGS. 4A and 4B. This reset signal RESET is supplied to the timing controller 130 and the timing controller 130 is reset. As the timing controller 130 is reset, gate control signals are generated again. As a result, all components of the LCD device 200 are reset.

In FIG. 3, the watchdog unit 110 includes a detecting unit 112 and a control signal generating unit 114. The detecting unit 112 outputs a detection signal 116 in response to the signal, GSP_FEED_BACK. As noted above, the signal, GSP_FEED_BACK indicates that a gate start pulse (GSP) is output from the timing controller 130 but is not fed back through the gate driver. The detecting unit 112 checks the feedback status of the gate start pulse (GSP) during several vertical synchronization periods to ensure the accuracy of determination prior to the output of the detection signal. The detection signal 116 is output to the control signal generating unit 114, as shown in FIG. 3. The control signal generating unit 114 outputs the control signal 118 to the reset signal generating unit 120.

The watchdog unit 110 detects this infrequent feedback status, and the reset signal generating unit 120 generates the reset signal and provides it to the timing controller 130. The timing controller 130 generates new signals, which may result in automatic resets the LCD device.

A feedback path for the gate control signals, for instance, the gate start pulse (GSP) is provided to determine whether the gate start pulse (GSP) is normally fed back through the gate drivers GD1~GD3. The watchdog module 110 performs this determination operation.

The detecting unit 122 of the watchdog unit 110 determines whether the gate start pulse (GSP) is being fed back during a predetermined vertical synchronization period through the path. Upon determination that the gate start pulse (GSP) is not fed back during a predetermined vertical synchronization period, the watchdog module 110 transmits the detection signal to the Control signal generating unit 114.

FIGS. 4A and 4B illustrate one example of the control signal and the reset signal RESET in response to the control signal. As the reset signal RESET is generated, the timing controller 130 responds and generates the gate control signal again, which results in the reset of the system.

As described in the above embodiments, determination is made as to whether the gate start pulse (GSP) is properly fed back during a certain vertical synchronization period. The watchdog unit 110 determines whether the gate driving unit is normally driven. When the gate driving unit experiences abnormal driving conditions, the reset pulse is generated to automatically reset the entire system. A defect on the screen due to an external factor may be prevented, thereby improving reliability of the LCD driving system. A user may no longer experience inconvenience because the LCD driving system automatically removes abnormal operation conditions.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

I claim:

1. A liquid crystal display (LCD) device, comprising:

a gate driver for supplying gate signals;

a timing controller for generating gate control signals including a gate start pulse to the gate driver;

a watchdog unit including a detecting unit and a control signal generating unit; and a reset signal generating unit receiving a control signal from the control signal generating unit, generating a reset signal and providing it to the timing controller when the gate start pulse is not normally fed back, wherein the detecting unit checks a feedback status of the gate start pulse during a several vertical synchronization periods to ensure the accuracy of determination prior to the output of a detection signal and transmits the detection signal to the control signal generating unit, and the control signal generating unit outputs a control signal upon receipt of the detection signal to the reset signal generating unit.

2. The LCD device of claim 1, wherein the watchdog unit generates a detection signal upon receipt of a signal indicative of the feedback status of the gate start pulse.

3. The LCD device of claim 2, further comprising:

a signal line to detect the feedback status of the gate start pulse.

4. The LCD device of claim 1, wherein the reset signal is supplied to the timing controller and the timing controller generates a new start pulse.

5. The LCD device of claim 2, wherein the signal indicative of the feedback status of the gate start pulse counts a number of signals that is fed back after the gate start pulse is sent to gate lines.

6. The LCD device of claim 3, wherein the signal line generates the signal indicative of the feedback status of the gate start pulse.

7. A driving method of a liquid crystal display (LCD) device having a gate driver and a timing controller, comprising:

supplying a gate control signal including a gate start pulse to the gate driver from the timing controller;

checking and determining a feedback status of the gate start pulse by a detecting unit of a watchdog unit during a several vertical synchronization periods;

outputting a detection signal indicative of abnormal feedback status by the detecting unit of the watchdog unit to a control signal generating unit;

outputting a control signal upon receipt of the detection signal indicative of the abnormal feedback status to a reset signal generating unit by a control signal generating unit of the watchdog unit;

producing a reset signal by the reset signal generating unit in response to the control signal; and, supplying the reset signal to the timing controller.

8. The method of claim 7, wherein the determining the feedback status of the gate start pulse comprises counting a number of the gate control signal that is fed back after the gate start pulse is sent to gate lines.

9. The method of claim 8, wherein the counting the number of the gate start pulse is repeated during multiple vertical synchronization periods.

10. The method of claim 7, further comprising:

transferring the determined feedback status of the gate start pulse via a signal line from the gate driver.

11. The method of claim 7, further comprising:

at the timing controller, generating a new gate start pulse upon receipt of the reset signal and supplying the new gate start pulse to the gate driver.

* * * * *